US006012172A

United States Patent [19]

Steffy

[11] Patent Number: 6,012,172

[45] Date of Patent: Jan. 11, 2000

[54] WATERPROOF HAT CONSTRUCTION AND METHOD FOR MANUFACTURING

[75] Inventor: Sharon L. Steffy, Reinhold, Pa.

[73] Assignee: Bollman Hat Company, Adamstown, Pa.

[21] Appl. No.: 09/210,397

[22] Filed: Dec. 14, 1998

[51] Int. Cl.[7] ..... A42B 1/06

[52] U.S. Cl. ..... 2/175.1; 2/175.2; 2/181

[58] Field of Search ..... 2/175.1, 175.2, 2/175.4, 175.5, 181, 195.1, 195.5, 195.6, 200.1

[56] References Cited

U.S. PATENT DOCUMENTS

| | | | |
|---|---|---|---|
| 1,222,528 | 4/1917 | Cohen . | |
| 1,658,590 | 2/1928 | Clements . | |
| 1,709,856 | 4/1929 | Kleinberg | 2/175.2 |
| 3,479,668 | 11/1969 | Bigler . | |
| 4,378,606 | 4/1983 | Snowden . | |
| 5,495,622 | 3/1996 | Kaufman . | |
| 5,636,382 | 6/1997 | Chopko et al. . | |

*Primary Examiner*—Diana Oleska
*Attorney, Agent, or Firm*—Shlesinger Arkwright & Garvey, LLP

[57] ABSTRACT

This invention is directed to a waterproof hat comprising an upperhat crown having an exterior surface and an interior surface, an upperhat brim extending from the upperhat crown, the upperhat brim having a outer perimeter edge, a liner constructed from waterproof material and having an exterior surface and an interior surface, the liner also provided with a crown and a brim interconnected at a joined surface extending only from the liner interior surface, the liner being adjacent the interior surface of the upperhat crown and secured at least to the upperhat brim at an outer perimeter edge and including a sweatband attached at the joined surface of he waterproof liner with stitches. The present invention is includes a waterproof hat where an insert or shell is sandwiched between an upperhat and a lining and underbrim in a manner so as to permit a sweatband to be sewn to the lining without damaging the insert.

5 Claims, 8 Drawing Sheets

WATERPROOF HAT CONSTRUCTION AND METHOD FOR MANUFACTURING

FIELD OF THE INVENTION

The present invention relates to hats, and in particular, hats adapted to function as rainwear.

BACKGROUND OF THE INVENTION

Conventional dress hats, cowboy hats, baseball caps and other hats provided with a brim are not well suited for extended use in the rain. In particular, the construction methods used are such that portions of the hat, for example, the crown region, are assembled by stitching. The stitching creates holes in the fabric which causes leaks.

While it is known to provide a hat having a layer of waterproofing material or fabric incorporated into the hat, it is also desirable to provide a sweatband within the crown of the hat, especially in case of dress or cowboy hats. For cowboy-type hats, the sweatband may also function to retain a chinstrap or the like. Sewing of the sweatband to the hat punctures the waterproofing layer and cause leaking to occur.

Numerous prior art hats incorporate GORETEX® or similar waterproof and breathable materials. However, in each of these cases the hat is not a dress hat, baseball or cowboy-type hat having the rigid, shaped construction typical of such hats nor exposed seams and sweatbands. Representative hats constructed from waterproof and breathable materials include U.S. Pat. No. 5,636,382 to Chopko et al. and U.S. Pat. No. 5,495,622 to Kaufman.

While the above noted prior art teaches GORETEX® or other waterproof and breathable materials within a hat construction, none of the prior art teaches securing a GORETEX® or other waterproofing sheet to both the underside of the brim and interior of the crown portion of the hat. In addition, the prior art fails to disclose hats having both a sweatband and layer of waterproof material sewn to the hat in a manner whereby the waterproof layer is not compromised in it's ability to repel moisture. Most importantly, none of the prior art teaches connection of a GORETEX® liner or insert to a hat, especially a seamless sheet of GORETEX® or similar material.

In view of the above, the present invention was developed.

OBJECTS AND SUMMARY OF THE PRESENT INVENTION

It is an object of the present invention to provide a dress hat, baseball cap, cowboy hat or other hat having a sheet or layer of waterproofing material and a sweatband incorporated into the hat without puncture of the waterproofing sheet or layer.

It is a still further object of the present invention to provide a sandwich-type construction for a waterproof hat whereby the waterproof material is disposed between an upper hat and an underhat without the expense of lamination.

A still further object of the present invention is to provide a dress hat or cowboy hat having a single, seamless sheet of waterproof material incorporated into the hat.

Yet a further object of the present invention is to provide a economical manufacture method for a novel waterproof dress hat including a sweatband.

Another object of the present invention is to provide a waterproof dress hat construction that is substantially leak-free and waterproof.

A still further object of the present invention is to provide a dress hat or cowboy hat having the aesthetic features traditionally associated with such hats while also incorporating into the hat waterproof construction materials.

In summary, the present invention is directed to a hat comprising a crown having an exterior surface and an interior surface, a brim extending from the crown, the brim having a outer perimeter edge, a liner constructed from waterproof material and having an exterior surface and an interior surface, the liner comprising a crown and a brim interconnected at a joined surface extending only from the liner interior surface, the liner is adjacent the interior surface of the crown and is at least secured to the brim at the outer perimeter edge and a sweatband attached at the joined surface to the waterproof liner with stitches.

The present invention is also directed to a hat comprising a crown having an exterior surface and an interior surface, a brim extending from the crown and having an underside, a seamless insert constructed from waterproof material, the insert positioned adjacent the crown interior surface and the brim underside, a lining having an interior surface and an exterior surface and comprising a crown portion and a brim portion interconnected therebetween at a joined surface extending only from the lining interior surface, the lining being interfit within the crown and adjacent the insert and secured to the brim underside and, a sweatband attached to the lining at the joined surface with stitches.

The present invention is further directed to a method for making a hat, the method comprising the steps of providing a crown having an exterior surface and an interior surface, securing a brim to the crown, the brim having a perimeter edge, providing a liner of waterproof sheet material having an exterior surface and an interior surface, the liner comprising a crown stitched to a liner brim at a joining surface extending only from the liner interior surface, positioning the liner adjacent to the interior surface of the crown, securing the liner only to the brim, providing a sweatband sized to interfit within the crown and stitching the sweatband to the liner at the joined surface.

The present invention is additionally directed to a method for making a hat comprising the steps of providing an upperhat comprising a crown having an exterior surface and an interior surface, securing an upperhat brim to the upperhat crown, the upperhat brim having an underside, providing a seamless insert of waterproof material, the insert having an exterior surface and an interior surface, positioning the insert adjacent each of the upperhat crown interior surface and the upperhat brim underside, providing a lining having interior and exterior surfaces and comprising a lining crown stitched to a lining underbrim at a joining surface extending only from the lining interior surface, positioning the lining against the insert and within the upperhat crown and adjacent the upperhat brim underside to thereby sandwich the insert between the lining and the upperhat, securing the lining and the insert to at least the brim of the upperhat, providing a sweatband sized to interfit within the crown of the upperhat and stitching the sweatband to the lining at the joined surface.

The above objects and advantages will be apparent from the various embodiments as set forth in the detailed description.

DETAILED DESCRIPTION OF THE INVENTION

Figure 1:
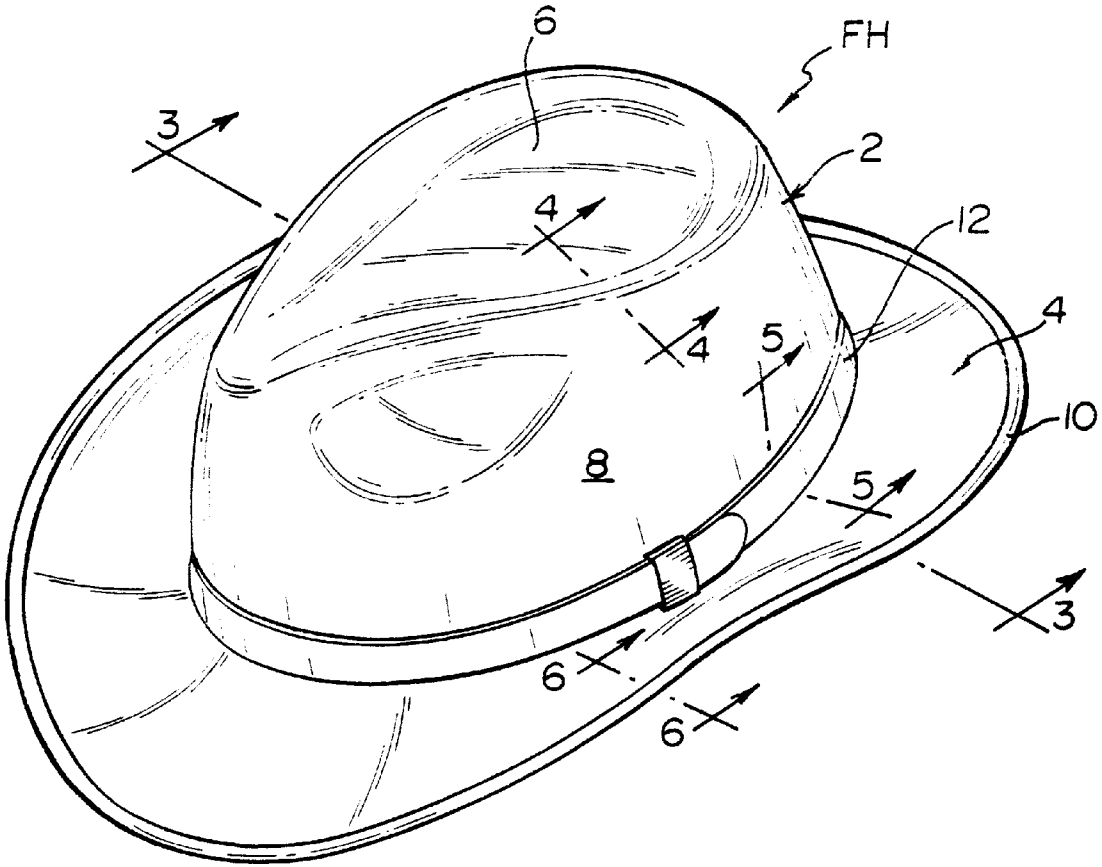
FIG. 1 is a perspective view of a finished hat according to the present invention.

FIG. 1 illustrates a finished or fully assembled cowboy-type hat or dress hat FH and generally comprises a crown portion 2 and brim portion 4. Other hats having an upstanding crown portion in combination with a brim are within the scope of the present invention.

Construction of the crown portion 2 and brim portion 4 may be accomplished in the known manner and typically involves selection of fabric or other material for the crown and the brim. The selected materials will of course vary, depending upon the type of hat to be constructed, how it is to be shaped and the desired functional characteristics of the finished hat.

In the usual case, the crown portion 2 may be formed from separate pieces of fabric that are sewn together and includes a top section or upper crown tip 6 sewn along a common edge to a side section or upper crown side 8. The side section 8 is then sewn to a brim portion 4 having an upper surface and an under surface. A wire (not shown) is typically sewn to a perimeter edge 10 of the brim and covered by a binding or edge covering. Following assembly of the upper hat UH, it is pressed into the desired shape and a hat band 12 is attached for decorative purposes by stitch 44.

Figure 2:
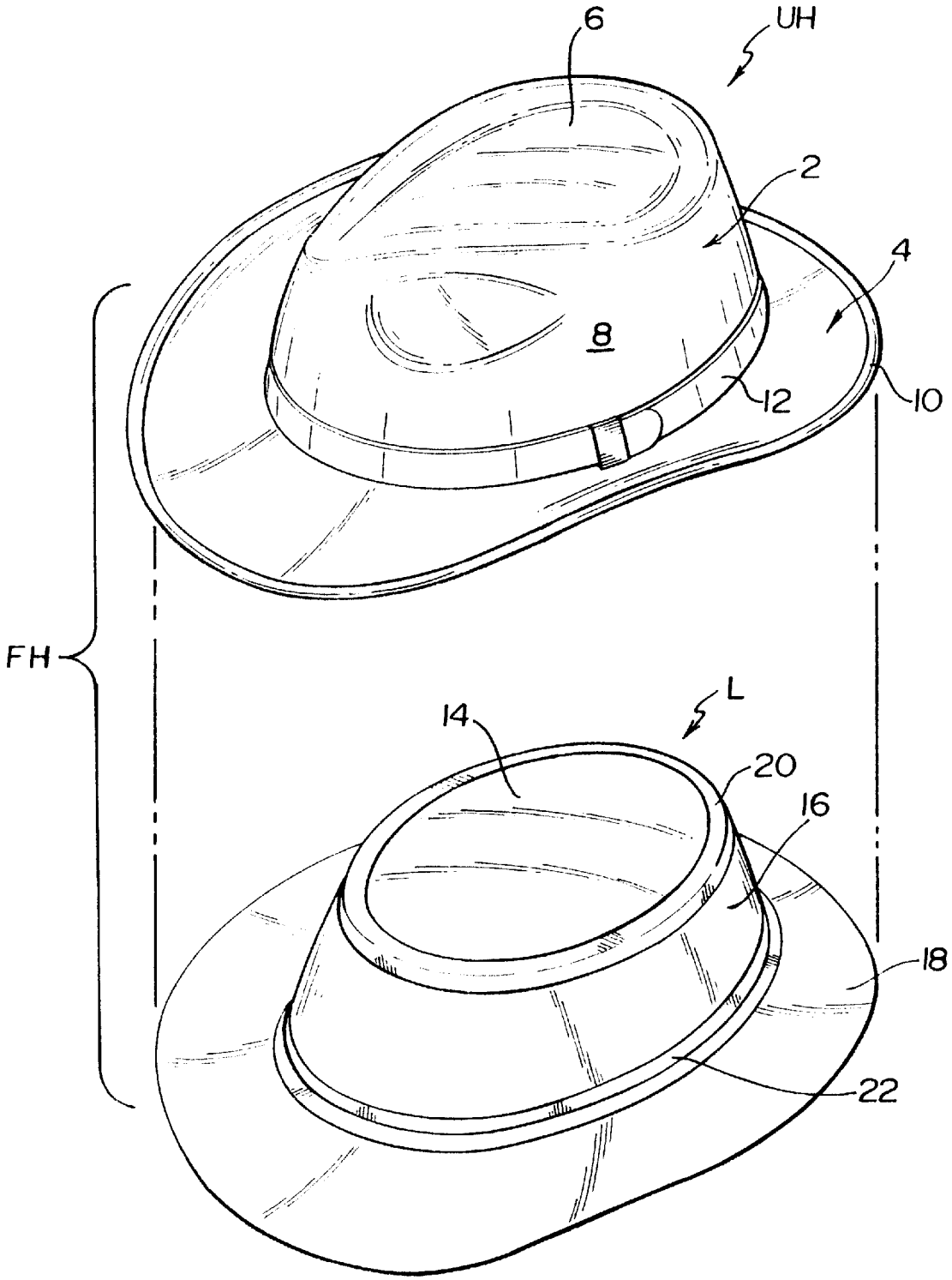
FIG. 2 is an exploded perspective view of a finished hat according to the present invention showing the underhat portion and the waterproof liner portion.
Figure 3:
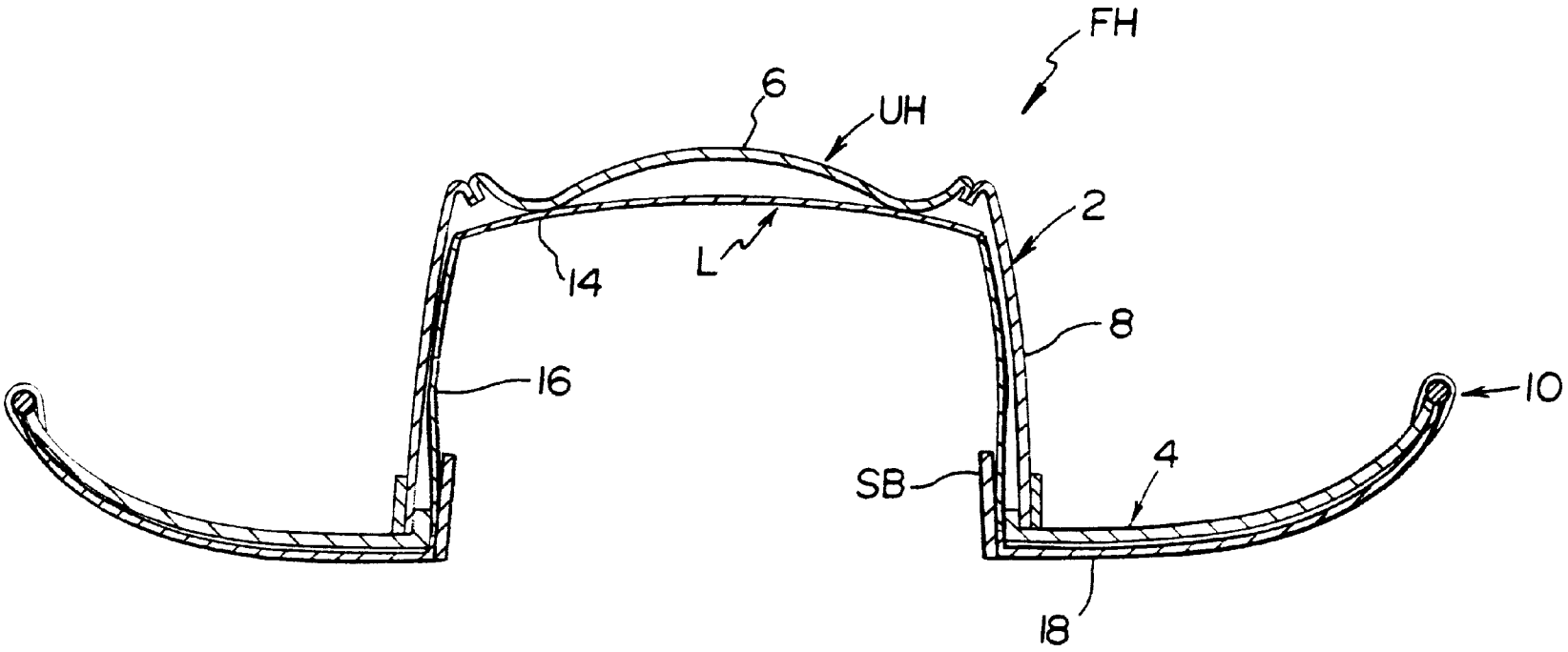
FIG. 3 is a cross-sectional view of the finished hat shown in FIG. 1 taken along lines 3—3.

Turning to FIG. 2, a finished hat FH is shown to comprise two portions; namely, the upperhat UH and the liner or underhat L, the liner is preferably constructed from a breathable, waterproof material. Breathable, waterproof material typically contains micropores sized to prevent liquid from passing through the material while allowing vapor to pass. In a preferred embodiment, the breathable, waterproof material is GORETEX®, a trademark name for a brand of polytetrafluoroethylene manufactured by W.L. Gore & Associates Inc.. Such material is described in U.S. Pat. Nos. 3,953,556 and 4,187,390. Equivalent materials and nonbreathable waterproof materials are also within the scope of the present invention. The waterproof materials may alternatively comprise a sheet coated with a hydrophobic material.

As best shown in FIG. 2, waterproof liner or underhat L is shaped to roughly mirror the general configuration of upperhat UH and will comprise a crown tip 14 secured along a perimeter edge to a crown side 16. The crown side 16 is further secured along a perimeter edge to an underbrim 18. Seam seals 20 and 22 are shown, seam seal 20 securing crown tip 14 to crown side 16 while seam seal 22 securing underbrim 18 to crown side 16 of the liner or underhat L. The finished hat FH is thus formed by joining the upperhat UH and the liner or underhat L.

FIGS. 7A through 7D illustrate construction of the liner or underhat L and in particular, the novel attachment of a sweatband SB to the liner or underhat L. As is apparent, the drawings are representational and not to scale. Accordingly, the size and surface area of the various portions will vary depending upon the type and size of the hat to be constructed.

In particular, the construction steps for the liner or underhat L shown in FIGS. 7A–D illustrate sewing of the sweatband SB to the waterproof liner or underhat L without puncturing or otherwise compromising the waterproofing capabilities of the liner or underhat L. Accordingly, when the liner or underhat L is secured to the upper hat UH to provide a finished hat FH, the finished hat remains 100% waterproof and therefore water will not leak through the liner or underhat L.

Figure 7A:
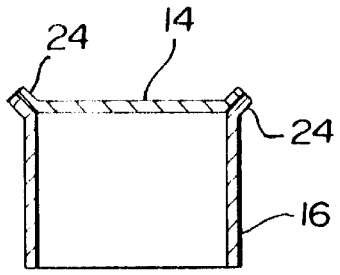
FIGS. 7A through FIGS. 7D illustrates construction steps for a waterproof liner according to the present invention.

Turning to FIG. 7A, the liner or underhat L is shown to comprise a crown tip 14 secured along a common edge 24 to crown side 16. The respective common edges 24 may be sewn, heat sealed, glued or otherwise secured together in face to face relation.

Figure 7B:
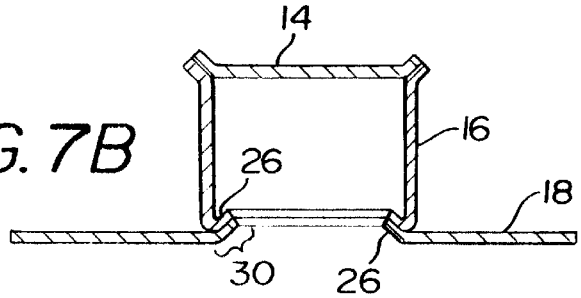

FIG. 7B illustrates attachment of an underbrim 18 of waterproof material, the underbrim having a configuration generally matching that of upperhat UH (not shown). The underbrim 18 is secured to the crown side 16 by sewing, heat sealing, gluing or the like along a common edge 26 and in a non-face side to non-face side relation. Joined of common edges 26 forms an inside seam or flange 30 to which a sweatband SB (not shown) may be secured using conventional stitching methods.

Figure 7C:
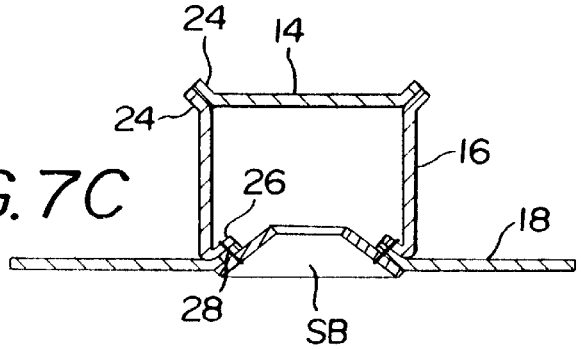

In particular, FIG. 7C illustrates attachment of a sweatband SB to the inside seam 30 of the liner or underhat L and in a manner that will not compromise the waterproof characteristics of the overall under hat L. That is, the stitching 28 does not extend through any exterior surface of the liner or underhat L. As a result, the integrity of the waterproof barrier formed by liner or underhat L is maintained and leakage from punctures is avoided.

Figure 7D:
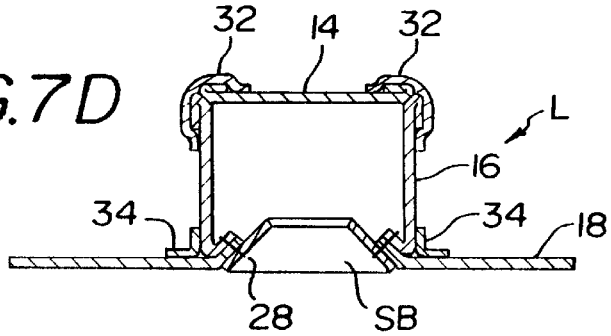

FIG. 7D shows the completed liner or underhat L having seam seals 32 and 34 applied to the liner by heat sealing or the like thereby rendering all the exposed, exterior surfaces of the liner or underhat L waterproof. As is apparent, sweatband SB may be provided with eyelets (not shown) as is known in the art for attachment of an optional chin cord or other strap device for maintaining the hat on the head of a user.

Figure 4:
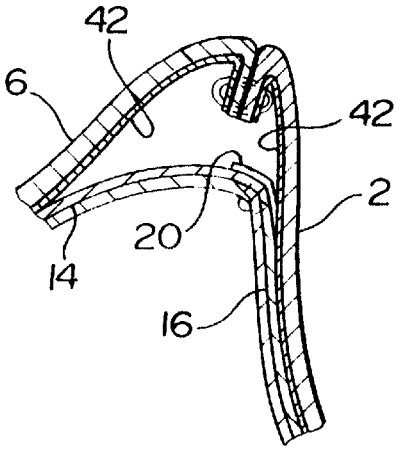
FIG. 4 is an enlarged cross-sectional view of a portion of the finished hat taken along lines 4—4 of FIG. 1.
Figure 5:
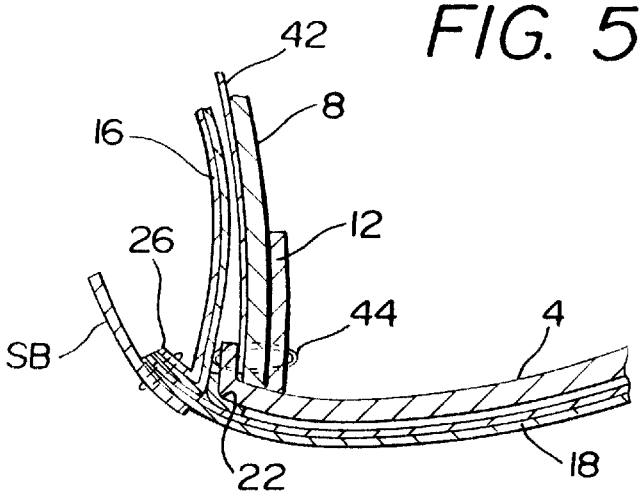
FIG. 5 is an enlarged cross-sectional view of a portion of the finished hat taken along lines 5—5 of FIG. 1.
Figure 6:
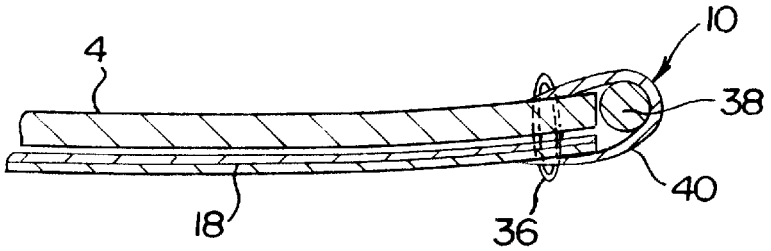
FIG. 6 is an enlarged cross-sectional view of a portion of the finished hat taken along lines 6—6 of FIG. 1.

The completed liner or underhat L with attached sweatband SB is inserted interior of upperhat UH and, in a preferred embodiment, is sewn into place. Stitching of the liner or underhat L to the upper hat UH is done at a perimeter edge 10 of the upperhat brim 4. FIGS. 4 through 6 illustrate details of the interconnection and/or relation between the various layers comprising the finished hat when fully assembled.

In particular, FIG. 6 shows a stitch 36 i.e. a line of stitching, extending through the brim portion 4 of the upperhat UH and the underbrim 18 of the liner or underhat L. At this location, penetration of the waterproof liner cannot compromise the ability of the liner to repel water since the connection is adjacent an outer edge of the hat that is remote from the wearer. As noted earlier, a wire 38 is sewn or otherwise bound to the perimeter edge 10 by way of a edge covering. As is apparent, the stitching 36 may function to not only secure the liner to the upperhat, but also secure the wire and covering to the perimeter edge of the brim.

FIGS. 4 and 5 illustrates addition of an optional mesh backer 42 to the interior surface of the crown portion 2 by fusing. The mesh backer 42 is preferably secured to the top section 6 and side section 8 of the crown portion prior to assembly. The mesh backer may provide support and breathability to the crown portion. In the alternative, a twill backer may be provided where a softer fabric is desired. Other fabric combinations for this or any other any portion of the upperhat UH are within the scope of the present invention. For example, the brim portion 4 of the upperhat UH may comprise a KORKTEX® material or other cork-like material that is relatively stiff and formable.

FIG. 5 shows the relative positioning of the upperhat UH to the liner L and in particular, the location of the sweatband SB and the stitches 28 and 44. A waterproof, stitchedless barrier is provided by the liner or underhat L.

As noted earlier, the final assembly step is sewing of the waterproof liner or underhat L to the interior surfaces of the upperhat UH. This is preferably accomplished by a single stitch line 36 extending along the perimeter edge 10 of the upperhat UH. The edge covering 40 is sewn around the wire 38 as shown in FIG. 6.

Liner or underhat L includes completely sealed seams rendering the entire finished hat FH waterproof. If desired, a chin strap may be attached to the sweatband by installation of eyelets through the sweatband without otherwise compromising the waterproofing capabilities of the hat.

The waterproof hat constructed in accordance with the above description, renders a dress or other hat having a sweatband 100% waterproof, yet the aesthetic features of the hat are not compromised. Thus, the hat according to the present invention provides both aesthetic and functional characteristics heretofore unavailable in the prior art.

Figure 8:
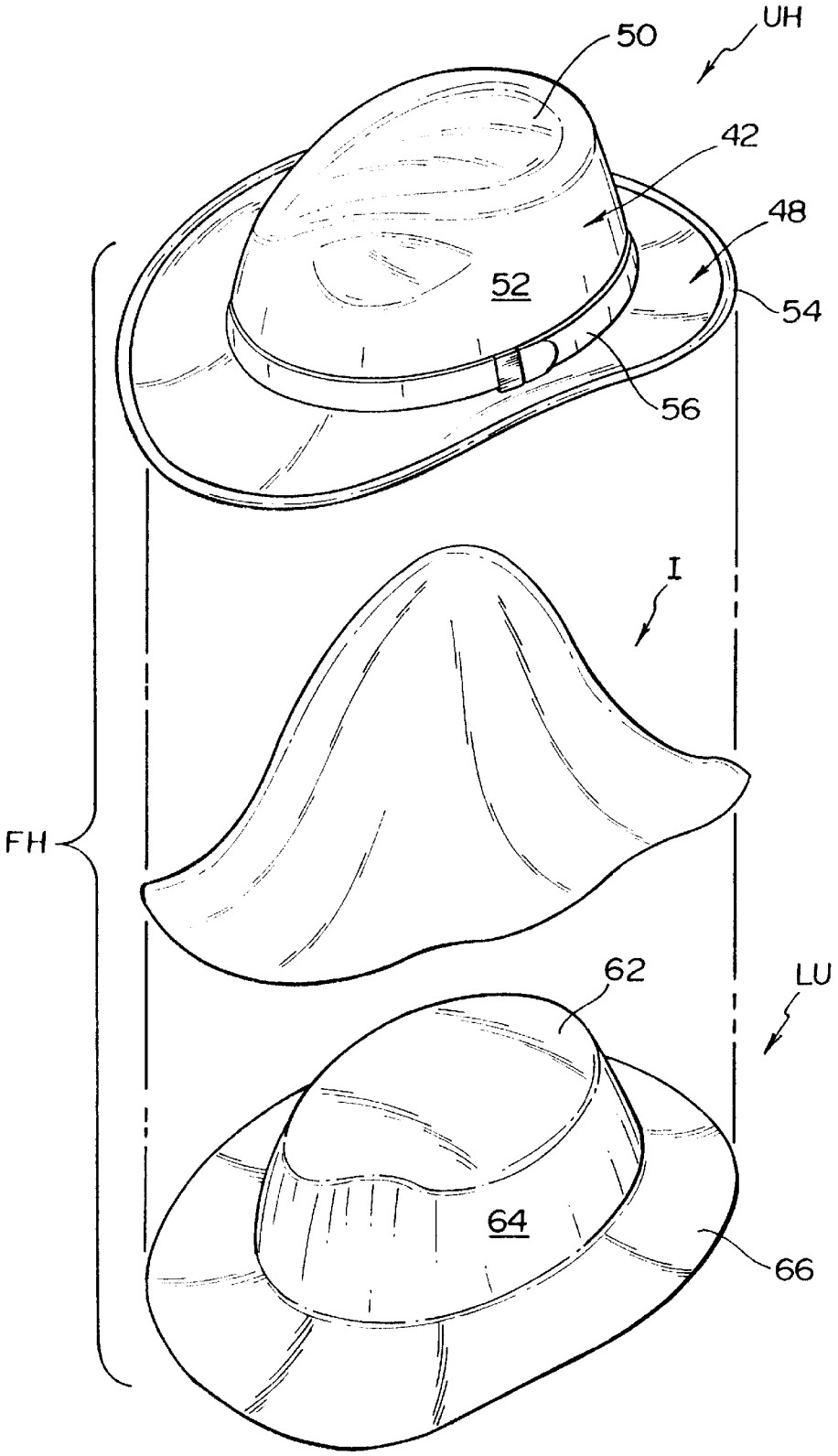
FIG. 8 is an exploded perspective view of an alternative embodiment of the present invention and shows an underhat portion, waterproof insert portion and the lining and underbrim portion.
Figure 9:
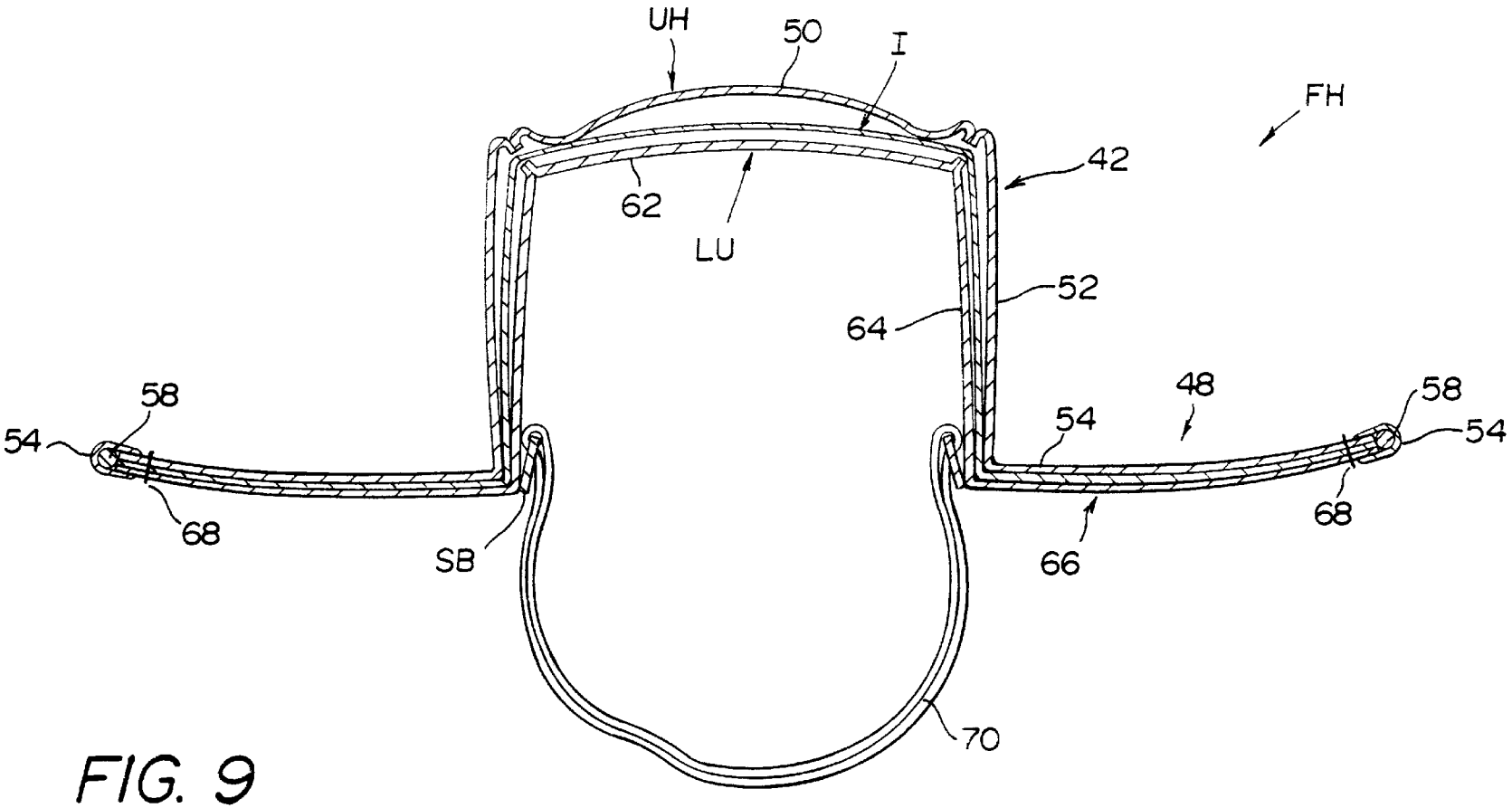
FIG. 9 is a cross-sectional view of a fully assembled finished hat shown in FIG. 8.
Figure 10:
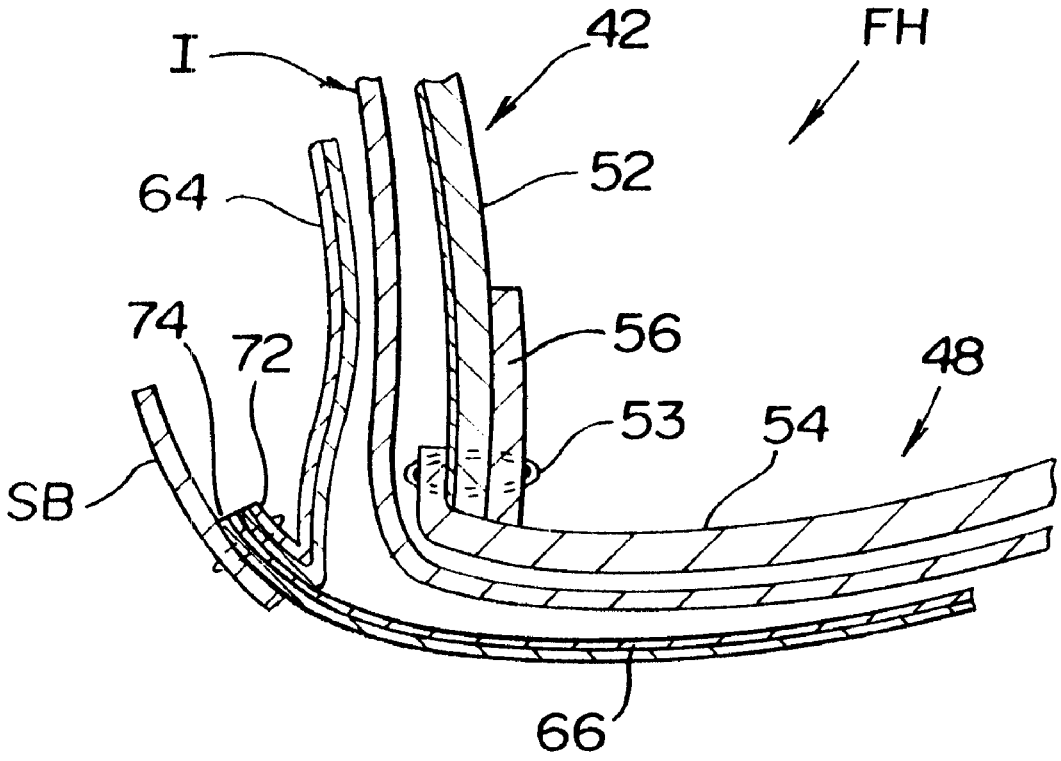
FIG. 10 is an enlarged cross-sectional view showing a portion of a fully assembled finished hat as set forth in FIGS. 8 and 9 and in greater detail.

An alternative embodiment of the present invention is shown in FIGS. 8, 9 and 10 whereby a finished hat FH comprises an upperhat UH, an insert or shell I of waterproof material, for example GORETEX®, and a lining or underbrim LU, all of which are arranged in a sandwich-type relation. FIG. 9 illustrates the general positioning of the various subparts forming the finished hat whereas FIG. 10 shows details concerning attachment of the sweatband to the interior of the hat crown.

The liner or underhat L described with respect to FIGS. 2–9 may be substituted for the insert or shell I of the present embodiment. However, it is preferred the insert or shell I will comprises a single sheet having a generally cone shaped configuration that is free of seams or the like.

Upperhat UH is constructed in a manner similar to that described with respect to the first embodiment. The upperhat UH thus comprises a crown portion 46 and a brim portion 48. The crown portion 46 includes a top section or upper crown tip 50 and a side section or upper crown side 52. The brim 48 includes a perimeter edge 54. A hat band 56 is provided around the bottom of the crown portion 46 and adjacent the rim portion 48. The upper crown tip 50 and the upper crown side 52 may be fused to a mesh backer as in the previous embodiment, the fused mesh backer providing support and breathability to the upperhat. The upper brim 48 is similarly glued or otherwise secured by stitching 53 to a KORKTEX® material or other material as desired. A wire 58 is sewn by stitching to a perimeter edge 54 of the brim 48 for purposes of rendering support and shapeability to the brim. The stitching may provide the dual function of securing the insert I to the upperhat and lining or underbrim as will be further explained below. After the various subparts of the crown 46 and brim 48 are assembled together, the hat is pressed into shape and the hat band 56 is attached to the crown.

A single piece insert or shell I constructed from GORE-TEX® material or other breathable and waterproof material is provided and placed adjacent the underside of the upper-hat UH. A lining or underbrim LU is also provided and placed against the insert I in a manner that will sandwich the insert I between the lining or underbrim LU and the upper hat UH.

To construct the lining, a lining side 64 and a lining tip 62 are sewn together to form a lining crown. A lining underbrim 66 is then cut to a desired shape and preferable fused to a reinforcing material, for example, 602 REMAY. An edge 74 of underbrim 66 is then sewn to an edge 72 of lining side 64 in a non-face side to a non-face side relation. This creates a surface for securing, by stitching 53, the sweatband SB to the lining and underbrim LU. The sweatband may include eyelets or passageways to allow attachment of a chin strap 70 or other device.

Once the lining and underbrim LU are assembled, the waterproof insert or shell I is sandwiched between the upper hat UH and the lining and underbrim LU in the manner as best shown in FIG. 9. The perimeter or brim edge 54 may then be stitched 68 using a non-wicking thread or other material thereby securing all three layers together. The stitching 68 is adjacent the perimeter edge 54 and a binding or edge covering 54 may be provided for decorative purposes. The brim is hand or machined shaped and the hat is complete.

It is within the scope of the present invention to substitute construction materials. For example, the mesh backer 42 secured to the crown 2 may be substituted for a twill cotton material or other material. In such embodiments, the stiffness provided by the mesh backer is not required and softness associated with the twill becomes a more desirable feature. Other material substitutions are likewise within the scope of the present invention. For example, the KORK-TEX® material may be substituted for cardboard or other material having different degrees of stiffness or flexibility. As is apparent, the brim does not require breathability; however, the GORETEX® material is incorporated into the brim to provide waterproofing. The crown portion of the hat will preferably be provided with a breathable material because a wearer will perspire and the vapor generated will pass through the GORETEX® material and exit the crown portion of the hat. Any support material may be incorporated into the brim portion of the hat so long as it maintains the required shapeability requirements for the final product. As noted earlier, the underside of the brim may be provided with a material such as 602 REMAY; however, other stiff fabrics or the like may be used.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A hat comprising:

a) a crown having an exterior surface and an interior surface;

b) a brim extending from said crown and having exterior surface and an underside;

c) a seamless insert of waterproof sheet material, said insert positioned adjacent said crown interior surface and said brim underside;

d) a lining having an interior surface and an exterior surface and including a crown portion and a brim portion interconnected at a joined surface extending only from said lining interior surface, said lining positioned adjacent said insert and secured to said brim underside; and e) a sweatband secured to said lining at said joined surface.

2. A hat as in claim 1 and wherein:

a) each of said lining and said sweatband are secured with stitches.

3. A hat as in claim 1 and further including:

a) a chinstrap secured to said sweatband.

4. A hat as in claim 1 and wherein:

a) said joined surface comprising a first flange extending from said lining crown portion and a second flange extending from said lining brim portion, each of said first and second flanges having exterior and interior surfaces coextensive with the respective one of said lining interior and exterior surfaces, said first flange exterior surface is joined against said second flange exterior surface and said sweatband is secured to one of said first and second flange interior surface.

5. A method for making a hat comprising the steps of:

a) providing an upperhat comprising a crown having an exterior surface and an interior surface;

b) securing an upperhat brim to the upperhat crown, the upperhat brim having an underside;

c) providing a seamless insert of waterproof material, the insert having an exterior surface and an interior surface;

d) positioning the insert adjacent each of the upperhat crown interior surface and the upperhat brim underside;

e) providing a lining having interior and exterior surfaces and including a lining crown stitched to a lining underbrim at a joining surface extending only from the lining interior surface;

f) positioning the lining against the insert within the upperhat crown and adjacent the upperhat brim underside to thereby sandwich the insert between the lining and the upperhat;

g) securing the lining and the insert to at least the brim of the upperhat;

h) providing a sweatband sized to interfit within the crown of the upperhat; and i) stitching the sweatband to the lining at the joining surface.

* * * * *